United States Patent [19]

Nomi

[11] Patent Number: 4,608,299

[45] Date of Patent: Aug. 26, 1986

[54] WATER-VAPOR-PERVIOUS, OPTIONALLY WATERPROOF, HEAT INSULATING MATERIAL

[75] Inventor: Haruo Nomi, Wake, Japan

[73] Assignee: Junkosha Company Ltd., Tokyo, Japan

[21] Appl. No.: 824,859

[22] Filed: Jan. 31, 1986

Related U.S. Application Data

[63] Continuation of Ser. No. 711,231, Mar. 13, 1985.

[30] Foreign Application Priority Data

Mar. 16, 1984 [JP] Japan ..... 59-45158

[51] Int. Cl.[4] ..... B32B 5/16; B32B 3/26

[52] U.S. Cl. ..... 428/283; 428/315.9; 428/316.6; 428/328; 428/422

[58] Field of Search ..... 428/283, 315.5, 315.7, 428/315.9, 316.6, 328, 422

[56] References Cited

U.S. PATENT DOCUMENTS

| | | | |
|---|---|---|---|
| 4,187,390 | 2/1980 | Gore | 428/315.5 |
| 4,194,041 | 3/1980 | Gore et al. | 428/315.5 |
| 4,344,999 | 8/1982 | Gohlke | 428/316.6 |
| 4,510,194 | 4/1985 | Miyake et al. | 428/316.6 |

*Primary Examiner*—William J. Van Balen

*Attorney, Agent, or Firm*—Mortenson & Uebler

[57] ABSTRACT

A water-vapor-pervious, optionally waterproof, heat insulating material is provided wherein a discontinuous layer of thin, reflective aluminum particles or flakes are adhered to a surface of a heat insulating material which is water-vapor-pervious and which may be waterproof, the adhesive being a resinous material which is pervious to water vapor.

1 Claim, No Drawings

WATER-VAPOR-PERVIOUS, OPTIONALLY WATERPROOF, HEAT INSULATING MATERIAL

CROSS-REFERENCE TO RELATED APPLICATION

This application is a continuation of prior copending application Ser. No. 06/711,231, filed Mar. 13, 1985 pending.

BACKGROUND OF THE INVENTION

This invention relates to a water-vapor-pervious warmth-retaining material. An objective is providing a novel material which possesses desirable perviousness to water vapor in addition to having the properties of a warmth-retaining, heat insulating material adapted to reflect light.

Heat insulating materials which are both water-vapor-permeable and waterproof are known such as, for example, the material described in U.S. Pat. No. 4,194,041.

Various metals and metallized materials possessing metallic gloss are capable of reflecting light and, as a result of dispersion of radiant heat, these materials manifest an advantageous warmth-retaining effect. This fact has been well known and has been utilized accordingly. There exist various substances which have metallic gloss. Among other substances of this class, aluminum possesses ease of fabrication and is comparatively low in cost. As a result of these advantages, aluminum is utilized extensively in the form of foil, particles, flakes, scales, and deposited layers. Aluminum foil, an aluminum layer vacuum-deposited on a substrate film of polyester or polyolefin,. and a coating layer having powdered aluminum dispersed on alkyd resin or polyester resin all possess a substantial heat retaining effect but all fail to exhibit perviousness to water vapor. Thus, these material inevitably find limited use in application which require perviousness to moisture indispensably, for example, under conditions involving heavy perspiration or in the presence of steam. In the case of an insulating construction material using aluminum foil, for example, this inevitably collects dew because of changes in atmospheric temperature or temperature differnece inside and outside the insulated room. Consequently, it suffers from a shortened service life and impaired appearance. There are indications that efforts are being made to impart to foils and other materials which are impervious to water vapor the desired perviousness to moisture by punching holes therein. This measure requires that a number of holes be formed and a high ratio of hole area to unit surface area. Further, this measure impairs the valuable property of reflection of heat rays and reduces the warmth-retaining property as well. In the case of a coating layer which is formed by using a resin solution containing powdered aluminum, it has been proposed previously to confer perviousness to water vapor in the coating layer by incorporation of a hole-forming agent in the resin solution, subsequently expelling the hole-forming agent by extraction or vaporization from the coating layer after formation of the coating layer, and consequently providing the coating layer having a porous texture attended by perviousness to water vapor. Despite these efforts, the coating layer so formed generally fails to acquire the needed perviousness to water vapor. The work involved in such a construction is complicated. Moreover, the introduction of such fine pores can adversely affect the properties of the resin and seriously degrade the strength and elongation of the coating material.

SUMMARY OF THE INVENTION

An improved water-vapor-perivous, optionally waterproof, heat insulating material is provided comprising a water-vapor-pervious heat insulating base material, which may be waterproof, having a discontinuous layer of reflective particles adhered to a surface of this base material by a resinous adhesive which is pervious to water vapor. The reflective particles are preferably particles of aluminum and the base material is preferably porous, expanded polytetrafluoroethylene.

DETAILED DESCRIPTION OF THE INVENTION AND PREFERRED EMBODIMENTS WITH REFERENCE TO THE DRAWINGS

This invention substantially eliminates many of the drawbacks suffered by the aforesaid conventional materials. It is aimed at providing a water-vapor-pervious warmth-retaining material, characterized by having a discontinuous layer of thin aluminum particles, such as aluminum flakes, adhered to the surface of a heat insulating material which is pervious to water vapor through the medium of a resinous adhesive binder which is pervious to water vapor.

Various heat insulating materials which are pervious to water vapor are available. For use in devices intended for outdoor service, these materials desirably possess waterproofness as well. As a material which combines waterproofness and perviousness to water vapor, there is the material described in U.S. Pat. No. 4,194,041. Other examples of a material having such properties include the porous, expanded polytetrafluoroethylene disclosed in U.S. Pat. No. 4,187,390, a laminated fabric of a non-hydrophilic porous film, a coated fabric of a non-hydrophilic porous layer (such as, for example, a coating of non-hydrophilic polyacrylic resin), a laminated fabric of steam-pervious non-porous film (such as, for example, a laminated fabric of a non-porous film of hydrophilic polyurethane resin or hydrophilic fluorine resin), a coated fabric of a steam-pervious non-porous layer (such as, for example, a coated fabric of a porous layer of hydrophilic polyurethane resin or hydrophilic fluorine resin), and other high-density fabrics comprised of very fine denier yarn. These materials may be suitably utilized as materials satisfying the requirement mentioned above. When such a waterproof, water-vapor-pervious fabric possesses high strength, the use of this fabric is advantageous in clothes and other similar articles of high quality.

The resinous adhesive binder to be used for the formation of the discontinuous water-vapor-pervious layer of thin aluminum particles or strips can be suitably selected from among the adhesive resins containing such hydrophilic groups as —CONH,—$NH_2$,—SH,—OH-,—O—$CH_2$—$CH_2$, and—COOH in their molecular units thereof.

As a means of adhering and superimposing the water-vapor-pervious layer containing the thin aluminum strips on the surface of the water-vapor-pervious heat insulating material, coating by the use of a roll coater is advantageously adopted. The superimposition can also be effected by the method of vacuum deposition. Although thin aluminum particles in the shape of flakes are in a discontinuous state, they are highly likely to be deposited substantially in parallel on the surface of the water-vapor-pervious heat insulating material during the course of application. Thus, they are discontinuous from the standpoint of perviousness to water vapor but they nevertheless constitute themselves in substantially a continuous layer with respect to their optical behavior in the reflection of light.

The water-vapor-pervious, warmth-retaining material of this invention can be utilized advantageously in materials for various sorts of clothes, bedclothes, heat insulating materials for buildings, shoes, gloves, hoods, masks, and other such articles. It can also be used advantageously in sleeping bags.

Working examples of the invention are provided below.

EXAMPLE 1

In a vessel made of stainless steel, 100 parts by weight of a water-vapor-pervious urethane resin (produced by Dai-Nippon Ink & Chemicals, Inc. and marketed under the trademark designation of Crisbon 14 ONS), 13 parts by weight of isocyanate (produced by Dai-Nippon Ink & Chemicals, Inc. and marketed under the trademark designation Crisbon NX), 3 parts by weight of a dibutyltin laurate catalyst (produced by Dai-Nippon Ink & Chemicals, Inc. and marketed under the trademark designation of Crisbon HM), 8 parts by weight of an aluminum-flake paste (produced by Toyo Aluminum Co., Ltd. and marketed under the trademark designation of Alpaste 0200M), and 30 parts by weight of toluene were thoroughly stirred with a mixer (produced by Tokushu Kikakogy Co., and marketed under the trademark designation of Homomixer FK). The resultant mixture was filtered through a screen of 100 mesh to produce a homogeneous coating liquid containing aluminum flakes and containing no coarse solid particles.

On a porous polytetrafluoroethylene film (available from W. L. Gore & Associates, Inc., Elkton, MD under the trademark designation of GoreTex®) having an average pore diameter of 0.2 μm, a porosity of 80%, and a thickness of 30 μm, the aforementioned coating liquid was applied with the aid of a roll coater to a thickness of about 10 μm. The coated film thus obtained was blown with hot air in a hot-air oven (150° C.) to expel the solvent and then cross-link the resin. As a result, a beautiful film having high metallic gloss was continuously produced.

Observation of this film under an electron microscope indicated the aluminum-flake layer to be formed having a uniform thickness of about 0.2 to 0.4 μm. This film was found by test to possess a high perviousness to water vapor in the range of 60,000 to 80,000 g/m$^2$.24 hours.

EXAMPLE 2

A coating liquid was obtained by following the procedure of Example 1, using 100 parts by weight of the same water-vapor-pervious urethane resin, 18 parts by weight of polyisocyanate (produced by Dai-Nippon Ink & Chemicals, Inc. and marketed under the trademark designation of Barnock DN-950), 3 parts by weight of a curing accelerator (produced by Dai-Nippon Ink & Chemicals, Inc. and marketed under the trademark designation of Axel T), 30 parts by weight of toluene, and 10 parts by weight of powdered aluminum (produced by Fukuda Kinzokuhakufun Kogyo K.K. and marketed under the trademark designation of No. 18000).

On a porous polytetrafluoroethylene film having an average pore diameter of 0.2 μm, a porosity of 80%, and a thickness of 25 μm, this coating liquid was applied to a thickness of about 15 μm with the aid of a roll coater. The coated film was treated in a hot-air oven at 150° C. for 15 minutes, to produce a beautiful film having high metallic gloss. This film was found by test to have perviousness to water vapor in the range of 30,000 to 40,000 g/m$^2$.24 hours.

EXAMPLE 3

A uniform coating liquid was obtained by following the procedure of Example 1, using 100 parts by weight of water-vapor-pervious thermoplastic urethane resin (produced by Dai-Nippon Ink & Chemicals, Inc. and marketed under the trademark designation of Crisbon 3314), 40 parts by weight of toluene, and 10 parts by weight of aluminum powder paste (produced by Toyo Aluminum Co., Ltd. and marketed under the trademark designation of Alpaste 0200N).

On a porous polypropylene film having an average pore diameter of 0.1 μm, a porosity of 35%, and a thickness of 25 μm (produced by Polyplastic Co.), the aforementioned coating liquid was applied to a thickness of about 10 μm with the aid of a roll coater. The coated film was then dried in a hot-air oven at 140° C. for 5 minutes, to provide a beautiful film having high metallic gloss. This film was found by test to possess perviousness to water vapor in the range of 30,000 to 40,000 g/m$^2$.24 hours.

Samples of the films obtained in Examples 1–3 as described above, an aluminized Mylar® polyester film which was 25 μm in thickness (polyester film having aluminum vacuum deposited thereon), commercially available microporous heat insulating materials A, B*, and aluminum foil were all tested for perviousness to water vapor, warmth-retaining property, and resistance to flexure. These tests were carried out as follows:

*A was a heat insulating material marketed by Asahikasei, K.K., under the trademark "LEOTHERMO" and B was a heat insulating material marketed by Toray, K.K., under the trademark "ENTRANT T".

(1) Determination of perviousness to moisture

A test cup was filled with a moisture absorbent (super-saturated potassium acetate solution) to two thirds of the cup capacity and a sample of the film was set in place over the mouth of the cup. The cup thus readied for test was weighed ($W_1$). Then the cup was placed upside down in a water bath (23° C.) held inside a constant temperature bath to ensure that the exposed surface of the sample would be wetted thoroughly. After elapse of a prescribed length of time (T hours), the cup was taken out of the water bath and weighed ($W_2$). The perviousness of the sample to water vapor was determined by the following formula.

$$\text{Perviousness to water vapor} = \frac{(W_2 - W_1)}{A \times T} \times 24$$

(wherein A denotes the area of the mouth of the cup).

(2) Determination of warmth-retaining property

A test sample was prepared by applying nylon taffeta of 70 denier (navy blue in color) securely to the surface of a given sample opposite its glossy surface. This test piece was exposed across a space of 25 cm to an infrared lamp having a surface temperature kept at 130° C. After 20 minutes' standing, the surface temperature of the test piece (surface temperature of the tightly applied taffeta) was measured with an infrared thermometer.

(3) Determination of resistance to flexure

A sample was placed in a clamp and bent alternately in opposite directions by 90° and, after a total of 20,000 cycles, was visually examined for any signs of change in surface appearance. The results of these tests are shown in summary in the following table.

| | Degree of perviousness to water vapor, $g/m^2 \cdot 24$ hours | Warmth-retaining property | Resistance to flexure |
|---|---|---|---|
| Example 1 | 60,000~80,000 | 40° C. | No change |
| Example 2 | 30,000~40,000 | 40° C. | No change |
| Example 3 | 30,000~40,000 | 40° C. | No change |
| Comparison (aluminized Mylar) | 0 | 38° C. | No change |
| Comparison (microporous A) | 1,500~2,000 | 40° C. | No change |
| Comparison (microporous B) | 2,000~3,000 | 42° C. | No change |
| Comparison (aluminum foil structure) | 0 | 38° C. | Breakage |

These test results indicate that the heat insulating material of this invention possess ability to pass water vapor, exhibits warmth-retaining property favorably comparable with an aluminum foil structure, excels in flexibility and bendability, permits very easy fabrication, permits very easy combination with other heat insulating materials, and, therefore, satisfies many requirements for utility in clothes, gloves, and other similar articles requiring careful fabrication.

As described above, this invention enables production of materials for clothes, bedclothes, and other similar articles which materials are capable of reflecting radiation heat and preserving warmth as well as materials for use on wall surfaces and ceiling surfaces. Because these materials combine an outstanding ability to reflect light and heat with advantageous transmission of water vapor, they provide unique properties heretofore never attained by materials of this kind. They further possess excellent flexibility and resistance to flexure breakage. In the various applications enumerated above, therefore, these materials manifest a high degree of usefulness.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. An improved water-vapor-pervious heat insulating material comprising a water-vapor-pervious insulating base material having a discontinuous layer of reflective particles adhered to a surface of said base material by a layer of non-porous resinous adhesive which is pervious to water vapor but impervious to liquid water, wherein said reflective particles are particles of aluminum and wherein said base material is porous, expanded polytetrafluoroethylene, and wherein the amount of said reflective particles is less than 10% by weight bases on said resinous adhesive.

* * * * *

UNITED STATES PATENT AND TRADEMARK OFFICE

CERTIFICATE OF CORRECTION

PATENT NO. : 4,608,299

DATED : August 26, 1986

INVENTOR(S) : Haruo Nomi

It is certified that error appears in the above-identified patent and that said Letters Patent is hereby corrected as shown below:

Please change Assignee: "Junkosha Company Ltd. Tokyo, Japan" to

--Japan Gore-Tex, Inc., Tokyo, Japan--

Signed and Sealed this

Twenty-seventh Day of January, 1987

*Attest:*

DONALD J. QUIGG

*Attesting Officer* *Commissioner of Patents and Trademarks*